US006406112B1

(12) United States Patent
Oikawa

(10) Patent No.: US 6,406,112 B1
(45) Date of Patent: Jun. 18, 2002

(54) INK JET RECORDING APPARATUS, RECORDING CONTROL METHOD, AND STORAGE MEDIUM WITH RECORDING CONTROL PROGRAM STORED THEREIN

(75) Inventor: Masaki Oikawa, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/210,551

(22) Filed: Dec. 14, 1998

(30) Foreign Application Priority Data

Dec. 15, 1997 (JP) ..... 9-345444

(51) Int. Cl.[7] ..... B41J 29/38
(52) U.S. Cl. ..... 347/9; 347/14; 347/17
(58) Field of Search ..... 347/9, 14, 17

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,172,142 A | | 12/1992 | Watanabe et al. | 347/14 |
| 5,610,638 A | * | 3/1997 | Courtney | 347/14 |
| 5,917,519 A | * | 6/1999 | Arai et al. | 347/41 |
| 6,116,710 A | * | 9/2000 | Tajika et al. | 347/14 |

FOREIGN PATENT DOCUMENTS

| | | | |
|---|---|---|---|
| EP | 0 496 525 | 7/1992 | B41J/2/195 |
| EP | 0 761 452 | 3/1997 | B41J/2/175 |
| JP | 54-56847 | 5/1979 | B91M/5/26 |
| JP | 57-14314 | 3/1982 | B41J/3/20 |
| JP | 59-138461 | 8/1984 | B41J/3/04 |
| JP | 60-71260 | 4/1985 | B41J/83/04 |
| JP | 7-323552 | 12/1995 | B41J/2/125 |

* cited by examiner

*Primary Examiner*—John Barlow
*Assistant Examiner*—Alfred E Dudding
(74) *Attorney, Agent, or Firm*—Fitzpatrick, Cella, Harper & Scinto

(57) ABSTRACT

In controlling recording executed by an ink jet recording head for ejecting a recording liquid, the present invention uses a temperature sensor to detect the temperature of the recording head, prints print image data after thinning the data depending on the detected temperature, and controls drive pulses so as to provide data that has not been thinned with a sufficient amount of ejection, thereby precluding ink from being excessively ejected despite an increase in the temperature of the ink jet recording head to avoid insufficient ejection recovery (refilling) in order to prevent the corresponding image from being disturbed.

19 Claims, 3 Drawing Sheets

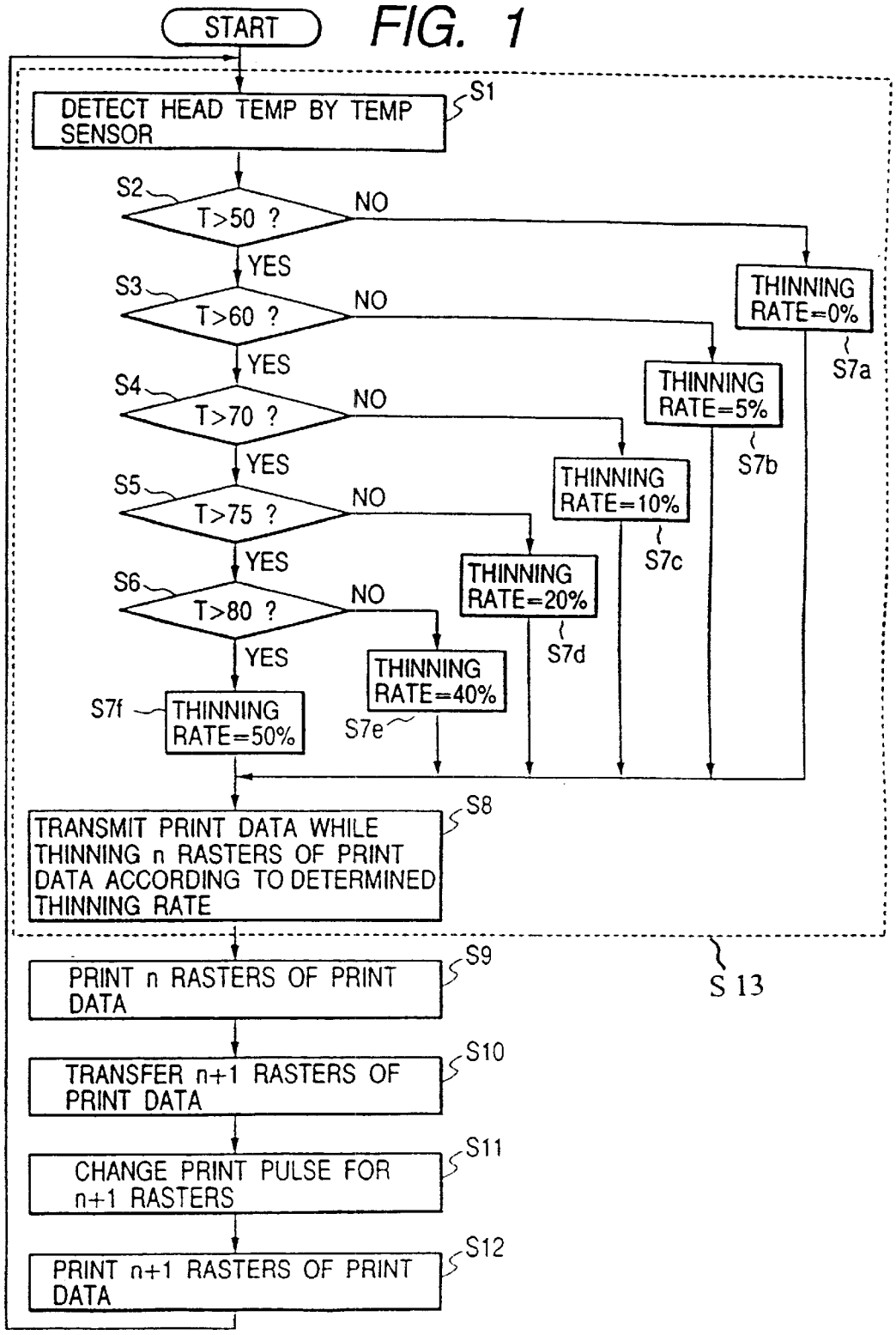
FIG. 1
START
DETECT HEAD TEMP BY TEMP SENSOR
S1
S2
T>50 ?
NO
YES
S3
T>60 ?
NO
YES
S4
T>70 ?
NO
YES
S5
T>75 ?
NO
YES
S6
T>80 ?
NO
YES
THINNING RATE=0%
S7a
THINNING RATE=5%
S7b
THINNING RATE=10%
S7c
THINNING RATE=20%
S7d
THINNING RATE=40%
S7e
S7f
THINNING RATE=50%
TRANSMIT PRINT DATA WHILE THINNING n RASTERS OF PRINT DATA ACCORDING TO DETERMINED THINNING RATE
S8
S 13
PRINT n RASTERS OF PRINT DATA
S9
TRANSFER n+1 RASTERS OF PRINT DATA
S10
CHANGE PRINT PULSE FOR n+1 RASTERS
S11
PRINT n+1 RASTERS OF PRINT DATA
S12

| HEAD TEMP [°C] | THINNING RATE [%] |
|---|---|
| 50 OR LOWER | NO THINNING |
| 50—60 | 5 |
| 60—70 | 10 |
| 70—75 | 20 |
| 75—80 | 40 |
| 80 OR HIGHER | 50 |

INK JET RECORDING APPARATUS, RECORDING CONTROL METHOD, AND STORAGE MEDIUM WITH RECORDING CONTROL PROGRAM STORED THEREIN

BACKGROUND OF THE INVENTION

1. Field of the Invention

The present invention relates to an ink jet recording apparatus for ejecting ink droplets against a recording medium, and to a recording control method and a storage medium with a recording control program stored therein.

2. Related Background Art

Ink jet recording apparatuses have been developed that eject droplets of a recording liquid from an ejection port (a discharge orifice) at the tip of a liquid passage in a nozzle for recording.

A representative example of a recording head used for such a recording apparatus uses thermal energy to generate bubbles in ink in order to eject the ink based on the generation of bubbles. All the generated thermal energy, however, is not consumed during ejection, and the residual thermal energy is accumulated and may increase the temperature to the extent that the recording head adversely affects the recording characteristics.

In general, an increase in temperature reduces the viscosity of a recording liquid (ink) to increase the amount of ink ejected beyond a predetermined value, thereby adversely affecting images or increasing the amount of ink used and thus running costs. If this increase in temperature is large, the recording head may be prevented from ejection or may be damaged.

Thus, conventional measures provide a radiating member in the apparatus or the recording head or provide the recording head with predetermined time required for cooling.

In addition, drive pulses are controlled depending on the temperature of the recording head in order to stabilize the amount of ejection despite an increase in the recording head. For example, as shown in FIGS. 4A to 4C, a double pulse is normally used for driving as shown by pulse waveform in FIG. 4A, but as the temperature of the recording head increases, a pulse width t1 is reduced as shown in FIG. 4B. Finally, a single pulse is used to control drive pulse as shown in FIG. 4C. Such drive pulse control can reduce the ejection efficiency relative to thermal energy to maintain the amount of ejection at a low level. That is, the conventional techniques stabilize the amount of ejection by changing the drive pulse from FIG. 4A to FIG. 4B and FIG. 4B to FIG. 4C as described above as the temperature of the recording head increases.

There is, however, a demand for the miniaturization or elimination of the radiating member as one of the improvements associated with the miniaturization of the recording head and cost reduction. In addition, the omission of measures such as the cooling time is also requested to achieve recording at a high speed.

On the other hand, the improvement of the drive pulse shown in FIGS. 4A to 4C enables recording until the recording head reaches 80° C. FIG. 5 shows the relationship between the increase in the temperature of the recording head and the amount of ink ejected in the case in which the drive pulse is controlled as shown in FIGS. 4A to 4C. FIG. 5 shows that when the head temperature (the temperature of the recording head) exceeds 50° C., the amount of ink ejected rapidly increases with increasing head temperature and that at 80° C., this amount becomes double the value obtained at the ordinary temperature. Thus, the amount of ink ejected increase far beyond the predetermined value to adversely affect images and to increase the amount of ink used and thus running costs.

In addition, the increase in the amount of ink ejected increases the time from the start of ink ejection until an ink channel is filled with the ink, that is, delays ejection return (refilling), thereby making ejection unstable or disabling ejection and increasing mists.

Furthermore, the head temperature is expected to further increase due to the further improvement of the drive pulse.

SUMMARY OF THE INVENTION

The present invention is provided to solve these problems, and its object is to provide an ink jet recording apparatus and recording control method that precludes an excessive amount of ink from being ejected despite an excessive increase in the temperature of the recording head to prevent a further increase in temperature and to enable sufficient ejection return (refilling), thereby preventing the corresponding image from being disturbed, as well as a storage medium with a recording control program stored therein.

To achieve this object, this invention provides an ink jet recording apparatus for ejecting a recording liquid from an ejection port at the tip of a liquid passage in a nozzle, characterized by comprising a recording head temperature detection means for detecting the temperature of the recording head and an image data change means for changing print image data according to the detection output of the recording head temperature detection means.

The image data change means may provide control such that the amount of print image data thinned from print image data is increased depending on an increase in the temperature of the recording head in accordance with the output from the recording head temperature detection means.

In addition, the image data change means may thin the first of at least two continuous dots of print image data at the individual ejection port.

Moreover, the apparatus may include a recording head drive control means for controlling driving conduction pulses for the recording head according to the detection output from the recording head temperature detection means.

Moreover, the recording head drive control means may apply driving conduction pulses such that at the individual ejection port, at least the dot following the thinned print image data has a larger amount of ejection than the other dots.

Moreover, the recording head uses thermal energy to generate bubbles in a recording liquid in order to eject the liquid with the generation of bubbles.

In addition, this invention provides a recording control method for an ink jet recording apparatus for ejecting a recording liquid from an ejection port at the tip of a liquid passage in a nozzle, comprising the first step of using a temperature sensor to detect the temperature of a recording head, the second step of printing print image data after thinning the data depending on the temperature detected at the first step, and the third step of printing print image data that has not been thinned at the second step by controlling drive pulses so as to provide a sufficient amount of recording liquid ejected.

The second step may set a thinning rate such that the amount of print image data thinned from print image data is increased depending on an increase in the temperature of the recording head detected at the first step.

In addition, the second step may determine the thinning rate by referencing a predetermined table that determines the relationship between the temperature of the recording head and the thinning rate.

Moreover, the second step may thin the first of at least two continuous dots of print image data at the individual ejection port.

Moreover, the third step may control driving conduction pulses for the recording head depending on the temperature of the recording head detected at the first step.

Moreover, the third step may apply driving conduction pulses such that at the individual ejection port, at least the dot following the thinned print image data has a larger amount of ejection than the other dots.

Furthermore, this invention provides a storage medium having stored therein a control program for controlling recording executed by an ink jet recording apparatus for ejecting a recording liquid from an ejection port at the tip of a liquid passage in a nozzle, characterized in that the control program allows a computer to detect the temperature of a recording head based on the output from a temperature sensor, to print print image data after thinning the data depending on the detected temperature, and to print print image data that has not been thinned by controlling drive pulses so as to provide a sufficient amount of recording liquid ejected.

Based on the above configuration, this invention detects the temperature of the recording head and thins dots of print image data according to the detected value to prevent an excessive amount of ink from being ejected. Consequently, the generated thermal energy can be reduced to preclude a further increase in temperature.

In addition, this invention controls the drive pulses for the dots preceding and following a thinned dot of print image data to thin the data in order to preclude the corresponding image from being adversely affected, thereby stabilizing the amount of ejection.

In addition, this invention increases the amount of print image data thinned with increasing temperature of the recording head to stabilize the amount of ejection.

In addition, this invention thins the first of two continuous dots of print image data at the individual ejection port to enable refilling for the second dot without delay, thereby preventing the corresponding image from being degraded due to insufficient refilling.

In addition, this invention controls drive pulses so that at the individual ejection port, the dot following the thinned print image data has a larger amount of ejection than the other dots, thereby preventing the thinning of print image data from adversely affecting the corresponding image.

BRIEF DESCRIPTION OF THE DRAWINGS

FIG. 1 is a flowchart showing a procedure for printing control according to one embodiment of an ink jet recording apparatus of this invention;

DETAILED DESCRIPTION OF THE PREFERRED EMBODIMENTS

An embodiment of this invention is described below in detail with reference to the drawings.

Figures 2, 3:
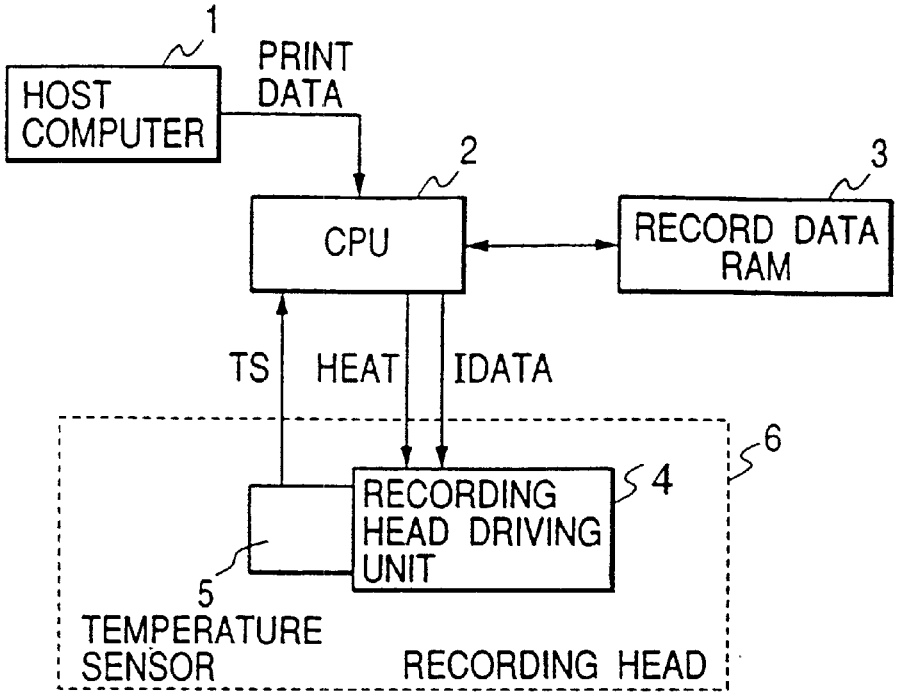
FIG. 2 is a block diagram showing an example of a configuration of a control system for controlling a printer section according to the embodiment of an ink jet recording apparatus of this invention.
FIG. 3 shows a memory map showing an example of a table in which correspondence data between the temperature of a head and the thinning rate is stored for printing control according to the embodiment of an ink jet recording apparatus of this invention.

FIG. 2 shows an example of a configuration of a control system for controlling a printer section according to one embodiment of an ink jet recording apparatus of this invention. In this figure, is a host computer that transmits print data (print image data) to a printer, 2 is a CPU (central processing unit) that provides control for this invention, 3 is a recorded data RAM (random access memory) in which recording extended data is stored that has been obtained by extending, for recording, print data received from the host computer 1, 4 is a recording head drive section for transmitting the recording extended data stored in the recorded data RAM 3, to a recording head 6 to allow the head to eject (or discharge) ink, and 5 is a temperature sensor that detects the temperature of the recording head 6. The recording head 6 uses thermal energy to generate bubbles in the ink in order to eject the ink with the generation of bubbles, and has an element (not shown) that generates thermal energy that is applied to the ink. This thermal energy generating element is connected to the output end of the recording head drive section 4.

The flowchart in FIG. 1 shows a procedure for printing control executed by the CPU 2 according to this embodiment. This procedure for printing control is stored in, for example, an ROM (not shown) in the CPU 2 in the form of a program. Next, the printing control operation of this embodiment is described in detail with reference to FIGS. 1 and 2.

First, in FIG. 2, print data is transmitted from the host computer 1, and the CPU 2 extends this data for recording and stores it in the recorded data RAM 3 as recording extended data. These operations are normally performed at a time for print data in several lines though they are limited by the capacity of the recorded data RAM 3. Once all the recording extended data stored in the recorded data RAM 3 has been transferred to the recording head 6, the print data in the subsequent several lines is extended to the recorded data RAM 3.

Next, at S1 (S represents a "step") in FIG. 1, the CPU 2 detects the current temperature of the recording head 6 from the detection output from the temperature sensor 5 for the recording head. Based on the detected temperature (head temperature), the CPU 2 determines the thinning rate for one raster of data to be transferred to the recording head 6. According to this embodiment, the thinning rate for the head temperature is determined according to the table in FIG. 3. That is, in the flowchart in FIG. 1, between S2 and S6, no thinning is executed when the head temperature is 50° C. or lower, the thinning rate is determined to be 5% between 50° C. and 60° C., the thinning rate is determined to be 10% between 60° C. and 70° C., the thinning rate is determined to be 20% between 70° C. and 75° C., and the thinning rate is determined to be 40% between 75° C. and 80° C. When the head temperature is 80° C. or higher, step S7 determines the thinning rate to be 50%.

Figure 5:
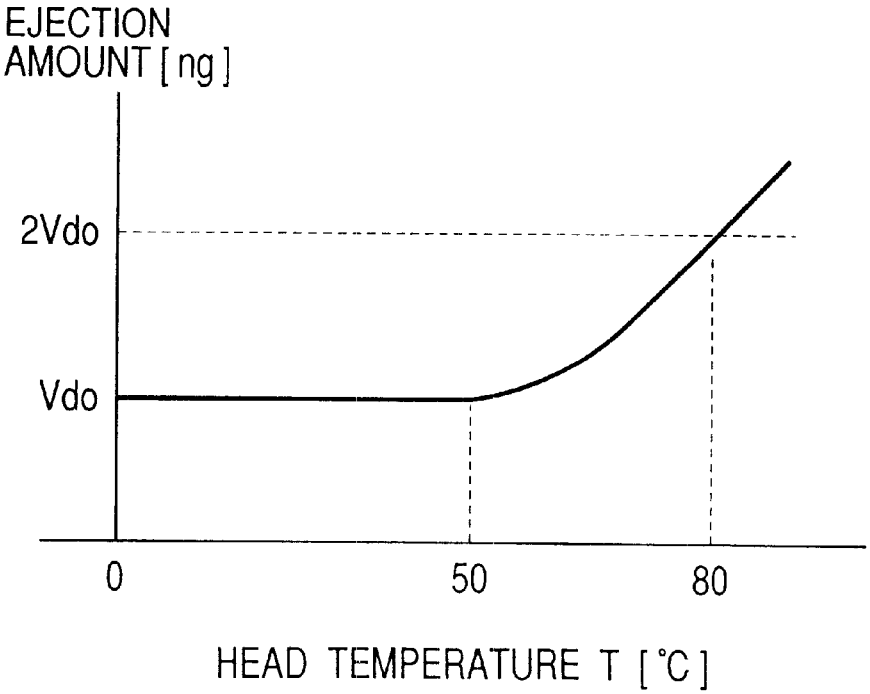
FIG. 5 is a graph showing the relationship between the temperature of a conventional recording head and the amount of ejection.

Thus, based on the ink ejection amount characteristic of the recording head 6 shown in FIG. 5, this embodiment controls the amount of ink ejected by increasing the increase rate for the thinning rate depending on an increase in the head temperature. If the radiating member of the recording head 6 is further miniaturized, the head temperature further increases. In this case, more control data must be provided in the table in FIG. 3.

Next, at S8, based on the thinning rate determined between S2 and S7, one raster (n-th raster) of print data is thinned while the thinned data is transferred to the recording head drive section 4.

At S9, the recording head drive section 4 allows the recording head 6 to execute printing on a recording medium (paper) according to the transferred print data (print image data).

At S10, the subsequent one raster (n+1-th raster) of print data is transferred to the recording head drive section 4. The printing of one raster is normally executed simultaneously with the transfer of the subsequent raster of print data. Thus, although, in FIG. 1, S9 and S10 are mutually separated for the clarity of description, they may be of course executed simultaneously.

Figure 4A:
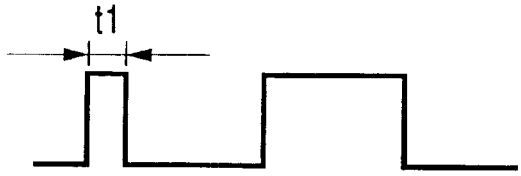
FIGS. 4A, 4B and 4C are timing charts showing a summary of conventional drive pulse control.
Figure 4B:
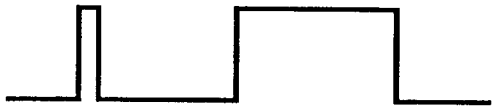
Figure 4C:
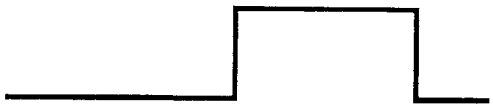

Next, at S11, the print pulse for the n+1-th raster is changed. Since the n-th raster has been thinned, the dots of the n+1-th raster must cover the dots of the n-th raster, so the print pulse is normally controlled to a single pulse as shown by the waveform in FIG. 4C. At S11, however, it is changed to a double pulse as shown by the waveform in FIG. 4A. This operation can prevent the image from being degraded due to the thinning of print data.

At S12, the recording head drive section 4 allows the recording head 6 to print the n+1-th raster. Since the printing of one raster is executed simultaneously with the transfer of the subsequent raster of print data, as described above, the operations in S12 and S13 (as which S1 to S8 are collectively referred to) may be performed simultaneously.

Although the series of operations in S1 to S12 print two rasters, recording printing can be carried out by repeating these operations.

According to this embodiment, print data is thinned before the image is transmitted from the recorded data RAM 3 to the recording head drive section 4. According to this invention, however, the recording head may execute the detection of the head temperature and the above control.

This invention may be achieved by a system consisting of a plurality of apparatuses or a single apparatus. Of course, this invention can be achieved by supplying a program to a system or an apparatus. In addition a storage medium for storing in the form of a program the control procedure according to this invention shown in FIG. 1 or storing the table shown in FIG. 3 may be a floppy disc or any of various other computer-readable storage media such as CD-ROMs or IC memory cards.

Based on the ink jet recording method, this invention includes a means (for example, an electrothermal energy converter or laser beams) for generating thermal energy as one used to eject the ink, and is effective on recording heads and apparatuses that use this thermal energy to change the conditions of the ink. This is because this method can improve the density and definition of recording.

The basic principle disclosed in U.S. Pat. Nos. 4,723,129 and 4,740,796 is preferably used as a representative configuration or principle for achieving this method. This method is applicable to both on-demand and continuous types, but is particularly effectively used for the on-demand type; in this case, at least one drive signal that corresponds to recorded information and that increases the temperature rapidly above the film boiling point is applied to an electrothermal energy converter arranged so as to correspond to a sheet or a channel in which a liquid (ink) is retained, thereby generating thermal energy in the electrothermal energy converter to cause film boiling on the heated surface of the recording head, so that a bubble can be generated in the liquid (ink) so as to correspond to the drive signal on a one-to-one correspondence. The bubble is grown or contracted to eject the liquid (ink) through the ejection opening to form at least one droplet. If this drive signal is shaped like a pulse, the bubble is immediately appropriately grown or contracted to preferably achieve the particularly responsive ejection of the liquid (ink). Suitable pulse-shaped drive signals are described in U.S. Pat. Nos. 4,463,359 and 4,345,262. More excellent recording can be accomplished using the conditions for the temperature increase rate of the heated surface described in U.S. Pat. No. 4,313,124.

The recording head may be configured by combining an ejection port, a channel, and an electrothermal energy converter (a linear liquid channel or a perpendicular liquid channel) as described in the above specifications, but this invention may also be configured as in U.S. Pat. Nos. 4,558,333 and 4,459,600 wherein the heated portion is located in a bent region. Besides, this invention is also effective when configured as in Japanese patent Application Laid-Open No. 59-123670 disclosing the configuration in which a common slit is used as an ejection section for a plurality of electrothermal energy converter or as in Japanese Patent Application Laid-Open No. 59-138461 in which an opening absorbing the pressure wave of thermal energy corresponds to the ejection section. That is, whatever the form of the recording head is, this invention enables recording to be achieved reliably and efficiently.

Moreover, this invention can be effectively applied to a full-line type recording head having a length corresponding to the maximum width of a storage medium on which the recording apparatus records data. Such a recording head may be composed of a plurality of recording heads to meet this length or of a single recording head that is integrally formed.

Besides, this invention is effectively applied to the serial type such as that described above, a recording head fixed to the apparatus body, a replaceable chip type that is installed in the apparatus body to electrically connect thereto or to receive ink therefrom, or a cartridge type in which an ink tank is integrally provided in the recording head.

An ejection recovery means for the recording head or an extra supplementary means is preferably added to the present recording apparatus to further stabilize the effects of this invention. Specifically, such means include a capping, cleaning, pressurizing, or sucking means for the recording head, an extra heating means for generating heat using an electrothermal energy converter or another heating element or their combination, and an extra ejection means for executing ejection used for a purpose different from recording.

With respect to the types and number of recording heads mounted, for example, a single recording head may be provided for a single ink or a plurality of recording heads may be provided for multiple inks of different recording colors or densities. That is, the recording mode of the recording apparatus may not only be one for main colors such as black but may also include the integral configuration of a single recording head or a combination of a plurality of heads. This invention, however, is very effective on an apparatus including at least one of two recording modes for multiple different colors and a full color obtained by mixing colors.

In addition, although, in the above embodiment, the ink has been described as a liquid, it may be solidified at the room temperature or lower or may be softened or liquefied at the room temperature. Alternatively, since the ink jet method generally adjusts and controls the temperature of the ink between 30° C. and 70° C. to maintain the viscosity of the ink within a stable ejection range, the ink may become liquid when a recording signal is applied. In addition, to actively prevent thermal energy from increasing the temperature or evaporating the ink by using this energy to transform the ink from a solid state to a liquid state, the ink may be solidified when left and may be liquefied when heated. Thus, this invention is applicable to ink that is not liquefied unless it is subjected to thermal energy, such as one that is liquefied and ejected as a liquefied ink when thermal energy is applied according to a recording signal or that starts to be solidified as soon as it reaches the storage medium. Such ink may be retained as a liquid or a solid in recessed portions or through-holes in a porous sheet in such a way as to be opposed to the electrothermal energy converter, as described in Japanese Patent Application Laid-Open No. 54-56847 or No. 60-71260. According to this invention, the film boiling method is most effective on each of the above inks.

Besides, the present ink jet recording apparatus may be used as an image output terminal for data processing equipment such as computers, or a copier combined with a reader, or facsimile terminal equipment having a transmission and reception function.

As is apparent from the above description, this invention detects the temperature of the recording head to appropriately thin print image data depending on the detected value in order to preclude the ink from being excessively ejected. Consequently, it provides the significant effects of preventing a print image from being degraded, reducing running costs and generated thermal energy, preventing the temperature further increasing, and reducing power consumption.

In addition, this invention controls the drive pulses for the dots preceding and following a dot thinned from print image data to preclude the corresponding image from being adversely affected by the thinning of the print image data. It can also increase the amount of print image data thinned depending on an increase in the temperature of the recording head, thereby stabilizing the amount of ejection.

Moreover, this invention thins the first of two continuous dots of print image data to enable refilling for the second dot without delay in order to prevent the corresponding image from being degraded.

Moreover, this invention enables the radiating member for the recording head to be miniaturized or eliminated to reduce costs. In addition, the above cooling time can be omitted to enable fast recording.

What is claimed is:

1. An ink jet recording apparatus for ejecting a recording liquid from an ejection port at the tip of a liquid passage in a nozzle, comprising:

a recording head temperature detection means for detecting the temperature of a recording head;

an image data thinning means for performing a thinning operation of print image data so that print image data corresponding to a first raster is thinned at a predetermined rate and print image data corresponding to a second raster is not thinned, when the temperature of the recording head detected by said recording head temperature detection means exceeds a predetermined temperature; and a recording head drive control means for controlling driving pulses for driving the recording head, wherein said recording head drive control means controls driving pulses so that driving pulses applied in recording said first raster and driving pulses applied in recording said second raster differ from each other.

2. An ink jet recording apparatus according to claim 1, wherein said image data thinning means provides control such that the amount of print image data thinned from print image data is increased depending on an increase in the temperature of the recording head in accordance with the output from said recording head temperature detection means.

3. An ink jet recording apparatus to claim 2, wherein said image data thinning means thins the first of at least two continuous dots of print image data at the individual ejection port.

4. An ink jet recording apparatus according to claim 1, wherein said recording head drive control means controls driving pulses for the recording head according to the detection output from said recording head temperature detection means.

5. An ink jet recording apparatus according to claim 1, wherein said recording head uses thermal energy to generate bubbles in a recording liquid in order to eject the liquid with the generation of bubbles.

6. An ink jet recording apparatus according to claim 1, wherein said driving pulses are controlled so that the ejection amount of ink per droplet in recording said second raster is larger than that in recording said first raster.

7. An ink jet recording apparatus for ejecting a recording liquid from an ejection port at the tip of a liquid passage in a nozzle, comprising:

a recording head temperature detection means for detecting the temperature of a recording head;

an image data change means for changing print image data according to the detection output of said recording head temperature detection means; and recording head drive control means for controlling driving pulses for the recording head according to the detection output from said recording head temperature detection means;

wherein said recording head drive control means applies driving conduction pulses such that at the individual ejection port, at least the dot following the thinned print image data has a larger amount of ejection than the other dots.

8. A recording control method for an ink jet recording apparatus for ejecting a recording liquid from an ejection port at the tip of a liquid passage in a nozzle, comprising:

the first step of using a temperature sensor to detect the temperature of a recording head;

the second step of performing a thinning operation of print image data so that print image data corresponding to a first raster is thinned at a predetermined rate and print image data corresponding to a second raster is not thinned, when the temperature detected at the first step exceeds a predetermined temperature, and the third step of controlling driving pulses for driving the recording head so that driving pulses applied in recording said first raster and driving pulses applied in recording said second raster differ from each other.

9. A recording control method according to claim 8, wherein said second step sets a thinning rate such that the amount of print image data thinned from print image data is increased depending on an increase in the temperature of the recording head detected at the first step.

10. A recording control method according to claim 9, wherein said second step determines the thinning rate by referencing a predetermined table that determines the relationship between the temperature of the recording head and the thinning rate.

11. A recording control method according to claim 8, wherein said second step thins the first of at least two continuous dots of print image data at the individual ejection port.

12. A recording control method according to claim 8, wherein said third step controls driving pulses for said recording head depending on the temperature of said recording head detected at the first step.

13. A recording control method according to claim 12, wherein third step controls driving pulses such that at the individual ejection port, at least the dot following the thinned print image data has a larger amount of ejection than the other dots.

14. A recording control method according to claim 8, wherein said recording head uses thermal energy to generate bubbles in a recording liquid in order to eject the liquid with the generation of bubbles.

15. A recording control method according to claim 8, wherein, in said third step, the driving pulses are controlled so that the ejection amount of ink per droplet in recording the second raster is larger than that in recording the first raster.

16. A storage medium having stored therein a control program for controlling recording executed by an ink jet recording apparatus for ejecting a recording liquid from an ejection port at the tip of a liquid passage in a nozzle, wherein the control program can be read by the computer and comprises:

a code for allowing the computer to detect the temperature of a recording head based on the output from a temperature sensor;

a code for allowing the computer to print print image data after thinning the data depending on said detected temperature; and a code for allowing the computer to print print image data that has not been thinned by controlling drive pulses so as to provide this data with a sufficient amount of recording liquid ejected.

17. A storage medium according to claim 16, wherein the driving pulses are controlled so that the ejection amount of ink per droplet in recording the print data that has not been thinned is larger than that in recording the thinned print data.

18. A storage medium having stored therein a control program for controlling recording executed by an ink jet recording apparatus for ejecting a recording liquid from an ejection port at the tip of a liquid passage in a nozzle, wherein the control program can be read by the computer and comprises:

code for allowing the computer to use a temperature sensor to detect the temperature of a recording head;

code for allowing the computer to perform a thinning operation of print image data so that print image data corresponding to a first raster is thinned at a predetermined rate and print image data corresponding to a second raster is not thinned, when the temperature detected at the first step exceeds a predetermined temperature; and code for allowing the computer to control driving pulses for driving the recording head so that driving pulses applied in recording said first raster and driving pulses applied in recording said second raster differ from each other.

19. A storage medium according to claim 18, wherein the driving pulses are controlled so that the ejection amount of ink per droplet in recording the second raster is larger than that in recording the first raster.

* * * * *